US009166336B1

(12) United States Patent
Hartrim

(10) Patent No.: US 9,166,336 B1
(45) Date of Patent: Oct. 20, 2015

(54) POWER CORD MALE END HAVING AN IRREGULAR OCTOGONAL BODY WITH HOURGLASS-SHAPED SLOTS WITH CONCAVE SIDEWALLS

(71) Applicant: James Hartrim, Auburn, CA (US)

(72) Inventor: James Hartrim, Auburn, CA (US)

( * ) Notice: Subject to any disclaimer, the term of this patent is extended or adjusted under 35 U.S.C. 154(b) by 0 days.

(21) Appl. No.: 14/520,574

(22) Filed: Oct. 22, 2014

(51) Int. Cl.
*H01R 13/62* (2006.01)
*H01R 13/631* (2006.01)
*H01R 13/642* (2006.01)

(52) U.S. Cl.
CPC ..... *H01R 13/631* (2013.01); *H01R 13/642* (2013.01)

(58) Field of Classification Search
CPC ..... H01R 13/642
USPC ..... 439/374, 677–679
See application file for complete search history.

(56) References Cited

U.S. PATENT DOCUMENTS

| | | | | | |
|---|---|---|---|---|---|
| 2,895,119 | A | | 7/1959 | Montgomery, Jr. | |
| 2,946,977 | A | * | 7/1960 | Sheldon | 439/441 |
| 2,993,189 | A | * | 7/1961 | Schelke et al. | 439/136 |
| 3,234,464 | A | | 2/1966 | Cook | |
| 4,002,397 | A | | 1/1977 | Wang et al. | |
| 6,155,883 | A | * | 12/2000 | Chiu et al. | 439/695 |

* cited by examiner

*Primary Examiner* — Chandrika Prasad
(74) *Attorney, Agent, or Firm* — Crossley Patent Law

(57) ABSTRACT

A power cord male end alignment aid providing visual and tactile cues for accurate alignment of and insertion of each of a prong disposed on a male end of the power cord with and into an electrical connector of an electrical energy source by including an irregular octagonal adapter body having an aperture disposed proximal a bottom edge of a continuous perimeter thereof and at least a single one of and not more than a pair of an hourglass-shaped slot disposed between a pair of outer side edges of the perimeter. Each slot has a pair of mirror image concave side walls that securingly receive and retain the respective prong of the power cord male end. The aperture is configured to align with a ground prong receptacle of the three-hole wall outlet or a center of the charging port of a personal electronic device.

18 Claims, 7 Drawing Sheets

POWER CORD MALE END HAVING AN IRREGULAR OCTOGONAL BODY WITH HOURGLASS-SHAPED SLOTS WITH CONCAVE SIDEWALLS

BACKGROUND OF THE INVENTION

Various types of electrical plug adapter devices are known in the prior art. However, what is needed is a power cord male end alignment aid that provides both visual and tactile cues for the accurate alignment of and insertion of each of a prong disposed on a male end of the power cord with and into an electrical connector of an electrical energy source.

FIELD OF THE INVENTION

The present invention relates to electrical plug adapter devices, and more particularly, to a power cord male end alignment aid.

SUMMARY OF THE INVENTION

The general purpose of the present power cord male end alignment aid, described subsequently in greater detail, is to provide a power cord male end alignment aid which has many novel features that result in a power cord male end alignment aid which is not anticipated, rendered obvious, suggested, or even implied by prior art, either alone or in combination thereof.

To accomplish this, the present power cord male end alignment aid is provided for the accurate alignment of and insertion of each of a prong disposed on a male end of a power cord, such as a two-prong electrical plug or a charger cable of a charger for a portable electronic device, such as a cellular phone, with and into an electrical connector of an electrical energy source, such as a three-hole wall outlet or a charging port of the personal electronic device, respectively. The instant device includes an irregular octagonal adapter body having front and rear sides and a continuous perimeter therebetween. A round aperture, which is centrally disposed in the adapter body proximal a bottom edge of the perimeter, is configured to align with either a ground prong receptacle of the three-hole wall outlet when the adapter body is attached between a two-prong electrical plug or a center of the charging port and in a position adjoining a bottom side of the plate surrounding the charging port of the portable electronic device. At least a single one of and not more than a pair of an hourglass-shaped slot having a pair of mirror image concave side walls is disposed between a pair of outer side edges of the perimeter. Each slot is configured to securingly receive a respective prong of the male end of the power cord therethrough.

For the alignment of a two-prong electrical plug with a three-hole wall outlet, the pair of the hourglass-shaped slots, including a first slot and a second slot parallel to the first slot, is vertically disposed on the adapter body in a central position between the top edge and the aperture. In addition, a top side of each of the first and second slots is disposed equidistantly from the top edge. The first slot is longer than the second slot. The top edge is configured to align with an upper edge of the wall outlet. The aperture is configured to align with the ground prong receptacle of the three-hole wall outlet. Each of a tapered right and left upper side edge of the perimeter is configured to substantially diagonally align with a respective one of an upper corner of the male end of the power cord and each of a lower side edge of the perimeter is configured to diagonally align with a respective one of a lower corner of the male end of the power cord to provide visual and tactile alignment cues.

When the electrical connector is a charging port of a portable electronic device, the adapter body includes only the single one of slots, with the single slot being horizontally disposed in a central position proximal the top edge and the aperture being configured to align with a center of the charging port and in a position adjoining the bottom side of the plate.

The adapter body can be phosphorescent to assist in the use of the device by individuals with limited sight or in use in low light conditions or darkness.

Thus has been broadly outlined the more important features of the present power cord male end alignment aid so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
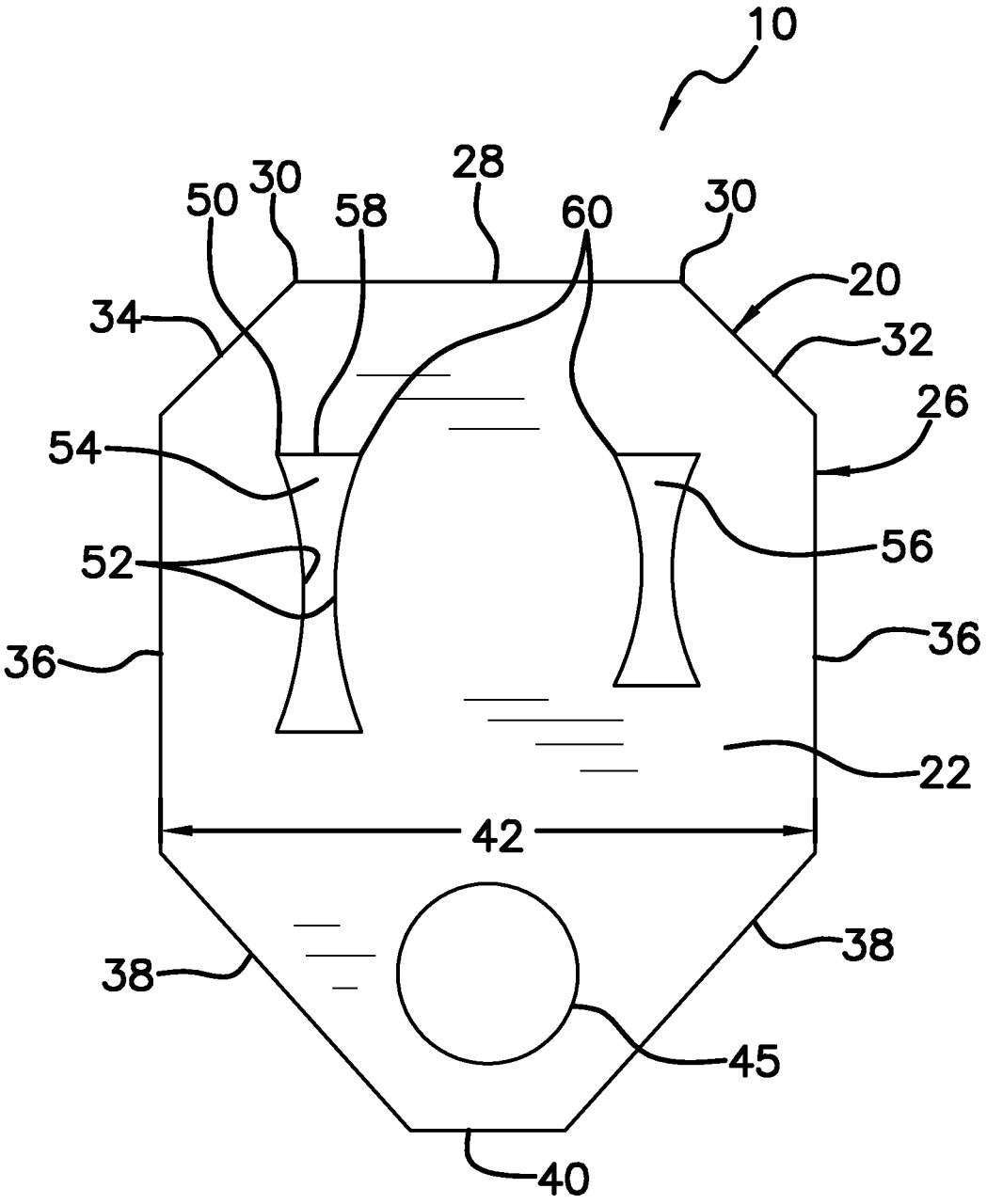
FIG. 1 is a front elevation view.
Figure 2:
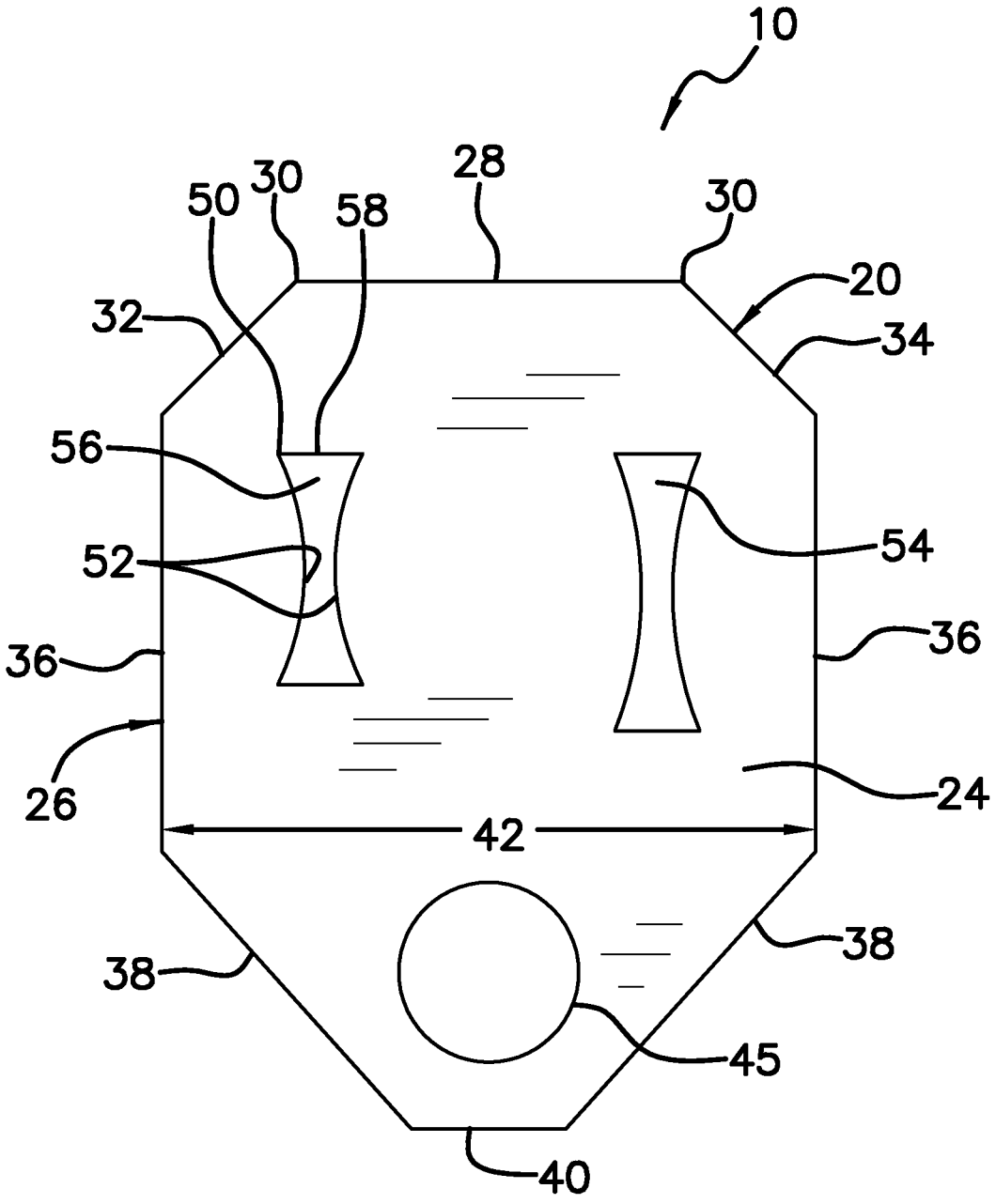
FIG. 2 is a rear elevation view.
Figure 3:
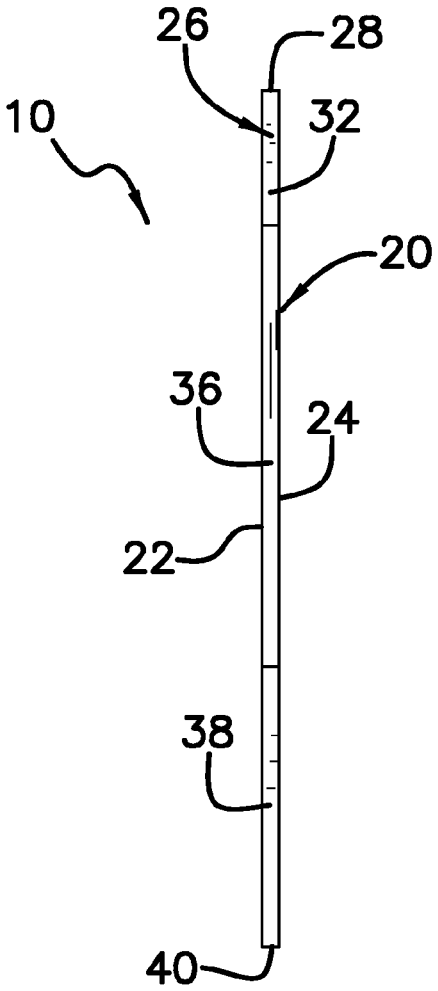
FIG. 3 is a right side elevation view.
Figure 4:
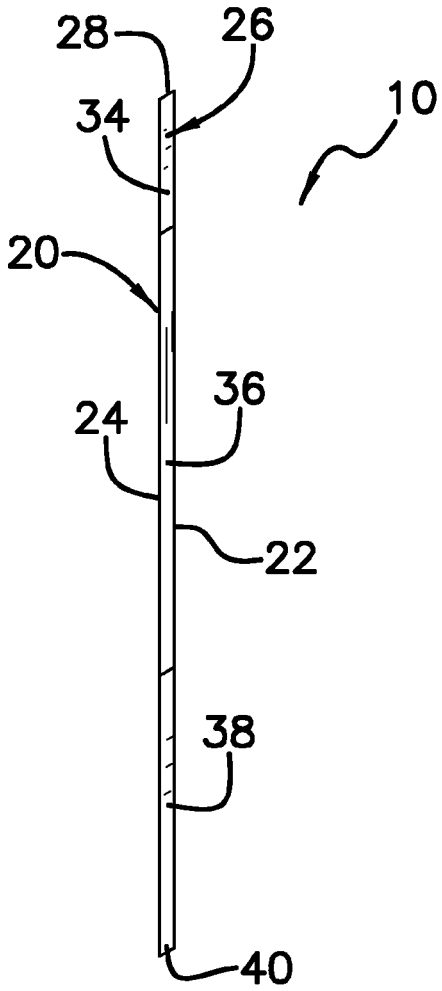
FIG. 4 is a left side elevation view.
Figure 5:
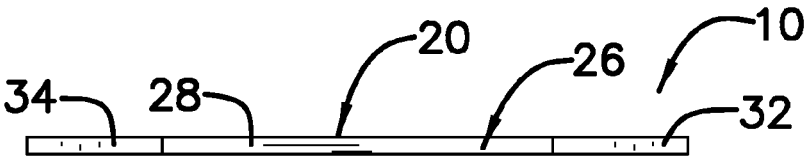
FIG. 5 is a top plan view.
Figure 6:
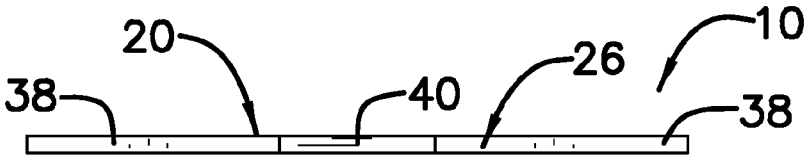
FIG. 6 is a bottom plan view.
Figure 7:
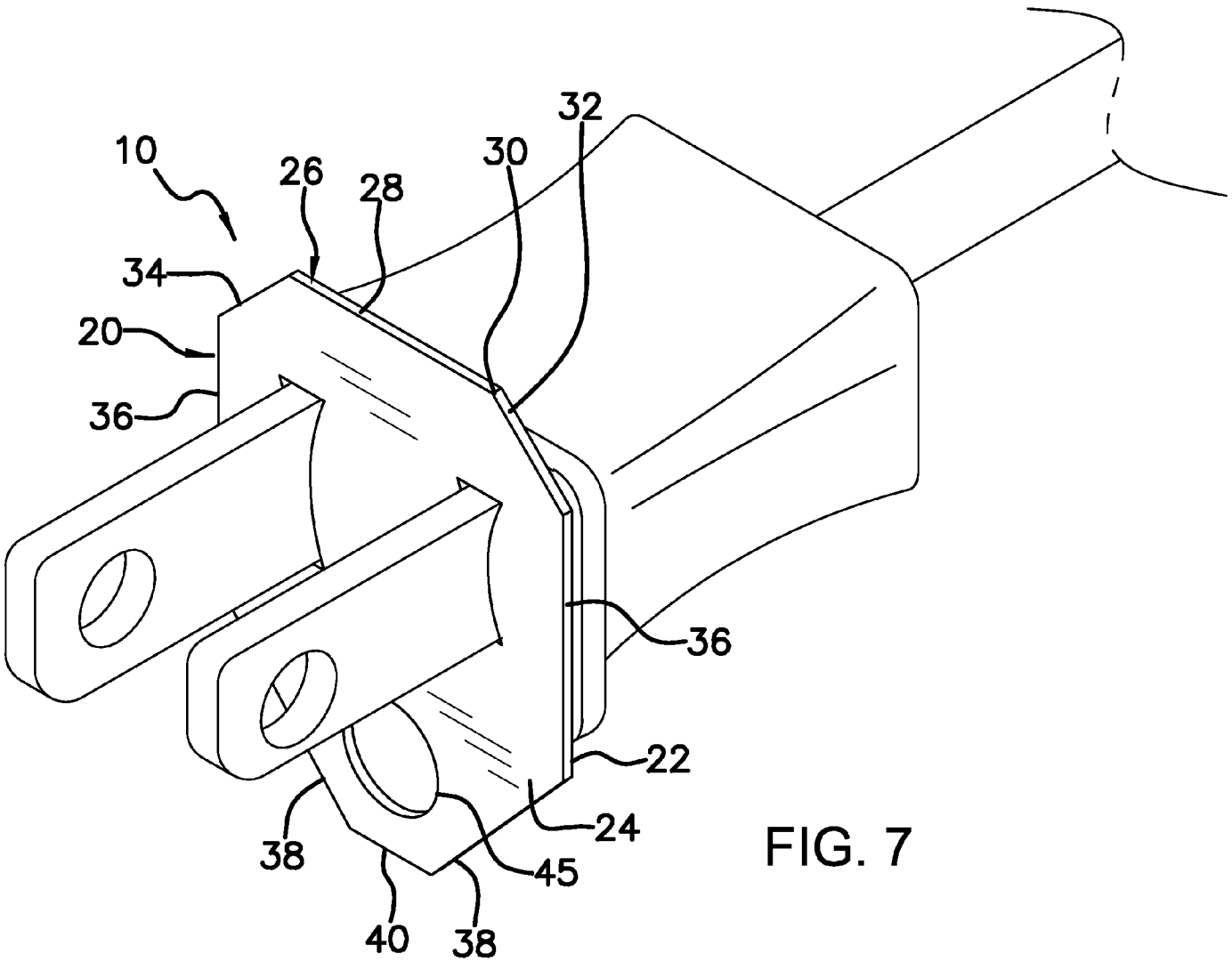
FIG. 7 is an in-use isometric view
Figure 8:
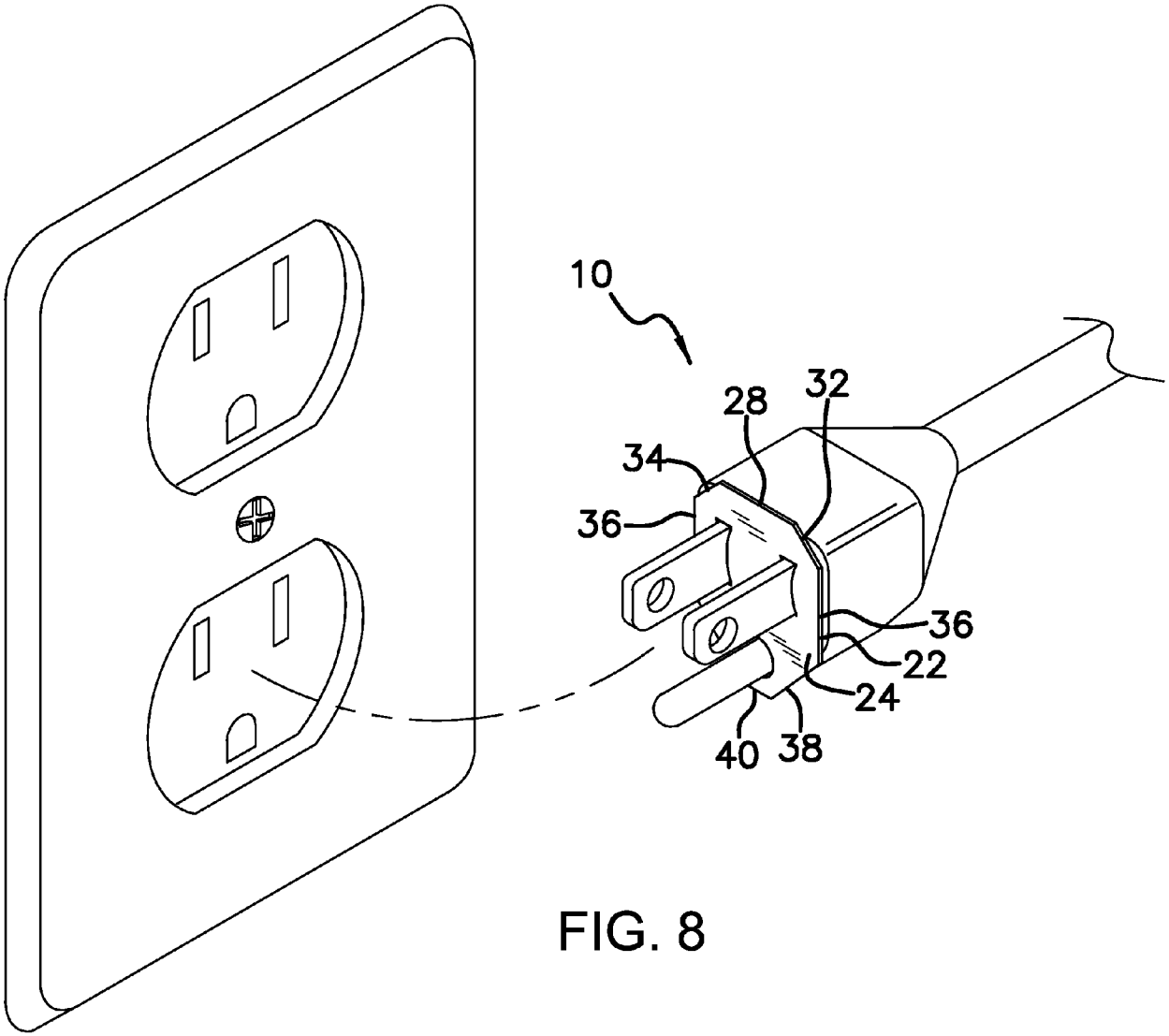
FIG. 8 is an exploded in-use view illustrating the installation of the present device over a 3-hole wall outlet and the insertion of a two-prong electrical cord into both the present device and the 3-hole wall outlet.
Figure 9:
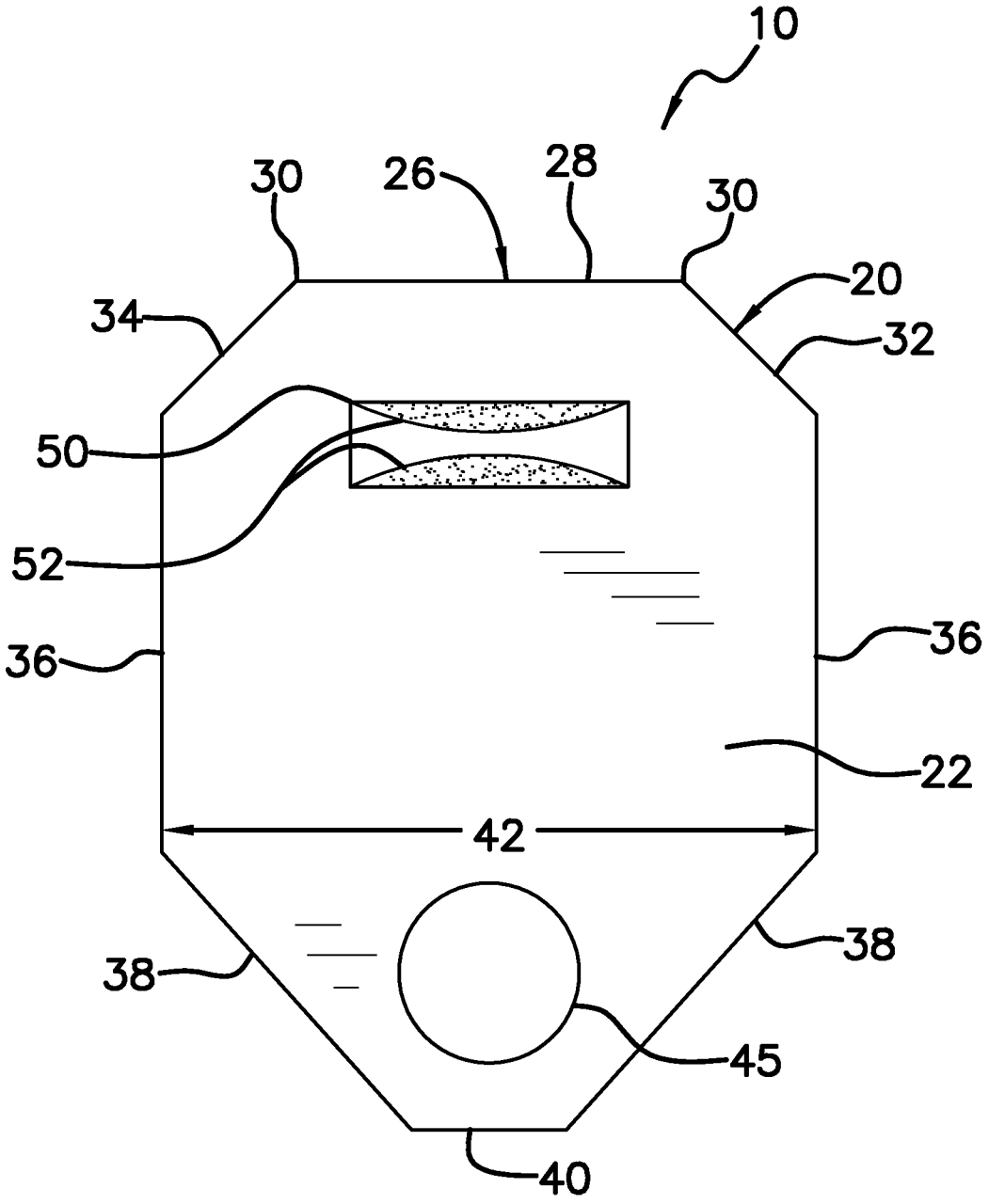
FIG. 9 is a front elevation view of the device with a single prong receptacle oriented in a horizontal position.
Figure 10:
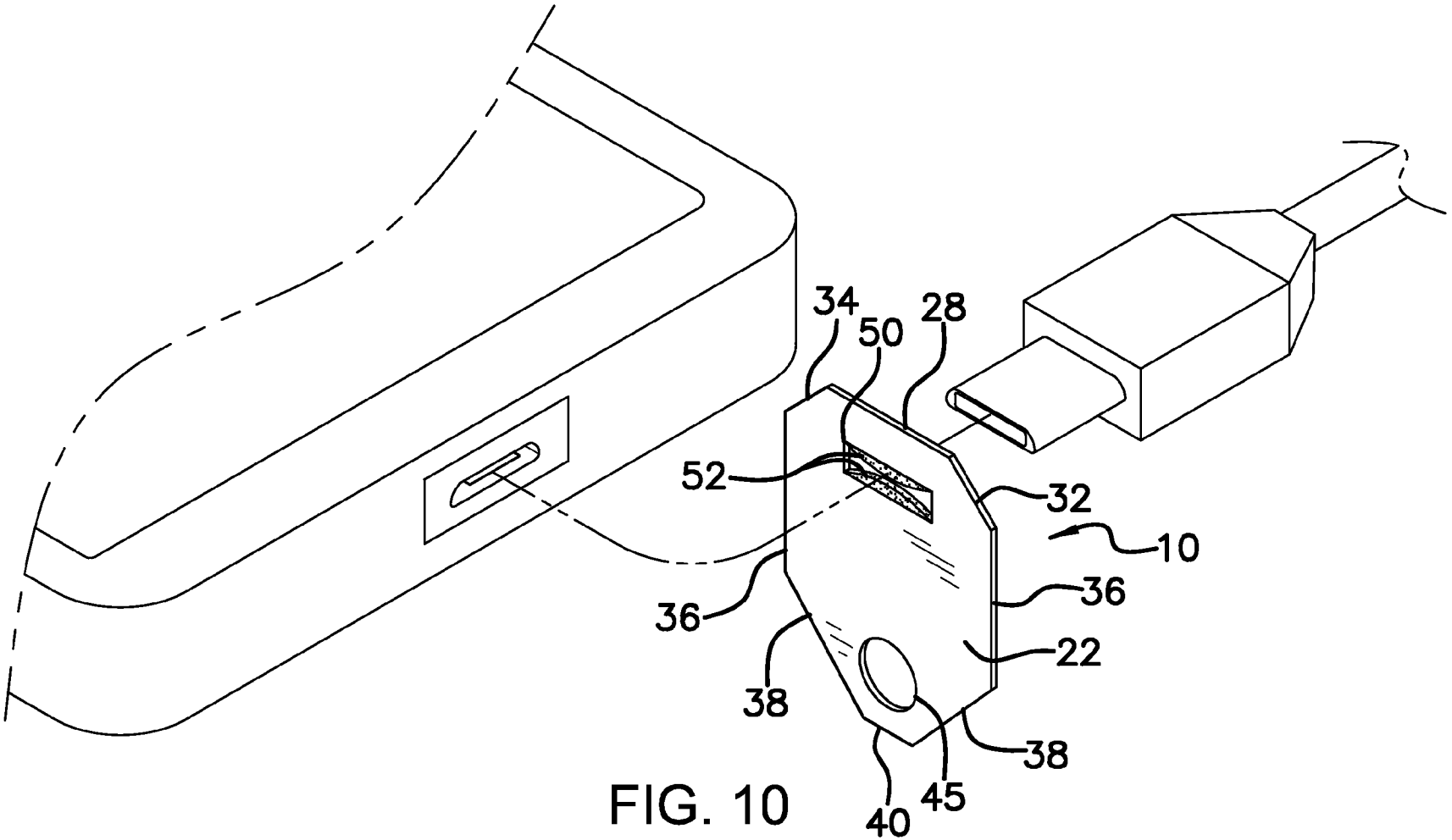
FIG. 10 is an in-use view illustrating the installation of the present device over a charging port of a portable electronic device and the insertion of a male end of a charger cable for the portable electronic device into the present device and the charging port.

With reference now to the drawings, and in particular FIGS. 1 through 10 thereof, an example of the instant power cord male end alignment aid employing the principles and concepts of the present power cord male end alignment aid and generally designated by the reference number 10 will be described.

Referring to FIGS. 1 through 10, the present power cord male end alignment aid 10 devised for accurate alignment of and insertion of each of a prong disposed on a male end of a power cord, such as a two-prong electrical plug or a charger cable of a charger for a portable electronic device, such as a cellular phone, with and into an electrical connector of an electrical energy source, such as a three-hole wall outlet or a charging port of the personal electronic device, respectively, is illustrated. The power cord male end alignment aid 10 includes an irregular octagonal adapter body 20. The adapter body 20 has a front side 22, a rear side 24, and a continuous perimeter 26 therebetween.

The perimeter 26 has a top edge 28 having a pair of first vertices 30 with each of first vertex 30 opposite each other, one of a tapered right upper side edge 32 and a tapered left upper side edge 34 attached to a respective one of the first vertices 30, an outer side edge 36 conjoined to one of each of the right upper side edge 32 and the left upper side edge 34 in a position perpendicular to the top edge 28. The perimeter 26 also has a tapered lower side edge 38 conjoined to each outer side edge 36 in a position opposite the respective right and left upper side edge 32, 34, and a bottom edge 40 conjoined to each lower side edge 38 in a position parallel to the top edge 28 and perpendicular to the outer side edges 38. The adapter body 20 further has a span 42 continuously disposed between the outer side edges 36. The span 42 is equal to a width of the male end of the power cord. Each of the front side 22, the rear side 24, and the perimeter 26 of the adapter body 20 is smooth. Each of the front side 22, the rear side 24, the top edge 28, the right upper side edge 32, the left upper side edge 34, the outer side edges 36, the lower side edges 38, and the bottom edge 40 is flat. The smooth and flat characteristics provide a more secure flush fit of the adapter body 20 against the electrical connector of the electrical energy source than would be provided by textured non-flat surfaces. The flush fit of the adapter body 20 against the electrical connector reduces debris, dust, hair, and similar particles in the area between the male end and the electrical connector and reduces the amount of such debris, dust, hair and similar particles entering through the electrical connector into the electrical energy source. Each of the right and left upper side edges 32, 34 and the lower side edge 38 is tapered to provide visual and tactile cues for alignment of the adapter body 20 with the plate surrounding the electrical connector and for alignment of each slot with the respective hole in the electrical connector. The visual and tactile cues also assist in safety and efficiency. For the insertion and retention of a two-prong power cord into a 3-hole wall outlet, the top edge 28 is configured to align with an upper edge of the wall outlet.

A round aperture 45 is centrally disposed between the lower side edges 38 in a position proximal the bottom edge 40. The aperture 45 is configured to align with either a ground prong receptacle of the three-hole wall outlet when the adapter body 20 is attached between a two-prong electrical plug or a center of the charging port and in a position adjoining a bottom side of the plate surrounding the charging port of the portable electronic device.

At least a single one of and not more than a pair of an hourglass-shaped slot 50 having a pair of mirror image concave side walls 52 is disposed between the outer side edges 36. Each slot 50 is configured to securingly receive each respective prong of the male end of the power cord, such as the two-prong electrical plug or the charger cable of a portable electronic device, therethrough. The concave side walls 52 have a distance between each other. The distance is configured to assist in the securing retention of the respective prong between the side walls 52. The hourglass-shape of each slot 50 provides a more secure contact between each slot 50 and respective prong thus more securely retaining each prong within the hourglass-shaped slot 50 than a rectangular shaped slot or a slot with flexible interior protrusions. The hourglass-shaped slot 50 with the concave side walls 52 self-affixedly secures the adapter body 20 and the male end of the power cord in the proper position and alignment with the electrical connector, without the application of an adhesive, such as glue.

For the alignment of a two-prong electrical plug with a three-hole wall outlet, there are a pair of hourglass-shaped slots 50, the pair of the hourglass-shaped slots 50 is vertically disposed on the adapter body 20 in a position parallel to each other and the pair of slots 50 includes a first slot 54 centrally disposed between the top edge 28 and the aperture 45 proximal the left upper side edge 34 and a second slot 56 disposed between the top edge 28 and the aperture 45 proximal the right upper side edge 32. A top side 58 of each of the first and second slots 54, 56 is disposed equidistantly from the top edge 28. The first slot 54 has a length longer than a length of the second slot 56. The top edge 28 is configured to align with an upper edge of the wall outlet. The aperture 45 is configured to align with the ground prong receptacle of the three-hole wall outlet. Each of the tapered right and left upper side edges 32, 34 is configured to substantially diagonally align with a respective one of an upper corner of the male end of the power cord and each lower side edge 38 is configured to diagonally align with a respective one of a lower corner of the male end of the power cord.

When the electrical connector is a charging port of a portable electronic device, the adapter body 20 includes only the single one of slots 50, with the single slot 50 being horizontally disposed in a central position proximal the top edge 28 and the aperture 45 being configured to align with a center of the charging port and in a position adjoining the bottom side of the plate.

The aperture 45 provides both visual and tactile cues for aligning each slot 50 with the respective electrical connector hole and guiding each prong on the male end of the power cord through the respective slot 50 and into the electrical connector. Thus, the aperture 45 assists individuals with limited sight and users in limited light conditions to properly align each slot with each hole in the electrical connector.

The adapter body 20 has one of a color selected from the visible spectrum of light. The color is one of a coloration of the plate, a bright, highly visible color of the adapter body 20 relative to the plate coloration, and a color of the adapter body 20 corresponding to a work-related use of the adapter body 20. Examples of the bright, highly visible color relative to the plate are a portland orange and an alternate scarlet color of the adapter body 20 in contrast to a beige coloration of the plate. Examples of a color of the adapter body 20 corresponding to a work-related use of the adapter body 20 are a white and an alternate citrine color of the adapter body 20 installed in a hospital setting and an asparagus green and an alternate carrot orange of the adapter body 20 used in connection with a power tool. The adapter body 20 can also be phosphorescent to provide an additional visual cue to assist in the installation of the device 10 between the male end of the power cord and the electrical connector in conditions of dim light or darkness and to assist individuals who have limited sight in the use of the device 10.

For use in aligning a two-prong electrical cord with a three-hole wall outlet, the male end of the electrical connector is positioned with the prongs directed away from the user and a larger of the two prongs disposed on the left side. With the adapter body 20 positioned with the front side 22 facing the user with the top edge 28 above the bottom edge 40 and the first slot 54 on the left side, the user slides the prongs through the respective first and second slots 54, 56 and the adapter body 20 against the male end. Upon sliding the prongs through the first and second slots 54, 56 and the adapter body 20 against the male end, the user aligns the aperture 45 with the ground prong receptacle of the three-hole wall outlet, aligns the top edge with the upper edge of the wall outlet, aligns the right and left upper side edges 32, 34 and the lower side edges 38 with the respective upper and lower corners of the plate surrounding the electrical connector and inserts the prongs into the holes of the electrical connector.

For use in aligning the single prong of the charger cable for the portable electronic device charger with the charging port of the portable electronic device, the male end of the changer cable is positioned with the single prong directed away from the user. With the adapter body 20 positioned with the front side 22 facing the user with the top edge 28 above the bottom edge 40, the user slides the single prong through the single slot 50 and the adapter body 20 against the male end. Upon sliding the prong through the slot 50 and the adapter body 20 against the male end, the user aligns the aperture 45 with the center point of the charging port in a position adjoining the bottom side of the plate and inserts the prong into the charging port of the personal electronic device.

The adapter body 20 is provided in several configurations with respective defined dimensions for utilization with respective electrical connectors and corresponding male ends and prongs disposed thereon of a power cord. However, as examples, the configurations and their respective dimensions are set forth hereinbelow.

For alignment of a two-prong electrical plug into a three-hole wall outlet, the adapter body 20 has a maximum length of 1.125 inches, a maximum width of 1.0 inch, and a depth of 0.03125 inches. The aperture 45 has a diameter of 0.25 inches and a center of the aperture is disposed 0.875 inches from the top edge. The top edge 28 has a width of 0.50 inches and the bottom edge 40 has a width of 0.25 inches. Each outer side edge 36 has a length of 0.50 inches. Each of the right upper side edge 32 and the left upper side edge 34 has a length of 0.25 inches. Each of the lower side edges 38 has a length of 0.50 inches. Each of the first and second slots 54, 56 has a maximum width of 0.375 inches. The first slot 54 has a length of 0.375 inches and the second slot 56 has a length of 0.25 inches.

In another example for use with alignment of a prong on the male end of the charger cable of the portable electronic device charger with the charging port of the portable electronic device, the adapter body 20 has a maximum length of 0.625 inches, a maximum width of 0.50 inches, and a depth of 0.03125 inches. The aperture 45 has a diameter of 0.0625 inches. The top edge 28 has a width of 0.3125 inches. The bottom edge 40 has a width of 0.1875 inches. Each outer side edge 36 has a length of 0.25 inches. Each of the right upper side edge 32 and the left upper side edge 34 has a length of 0.1875 inches. Each of the lower side edges 38 has a length of 0.25 inches. The single slot 50 has a maximum width of 0.0625 inches and a length of 0.25 inches.

In still another example, the adapter body 20 has a maximum length of 1.125 inches, a maximum width of 1.0 inches, and a depth of 0.03125 inches. The aperture 45 has a diameter of 0.25 inches. The top edge 28 has a width of 0.50 inches. The bottom edge 40 has a width of 0.25 inches. Each outer side edge 36 has a length of 0.25 inches. Each of the right upper side edge 32 and the left upper side edge 34 has a length of 0.1875 inches. Each of the lower side edges 38 has a length of 0.25 inches. Each of the first and second slots 54, 56 has a maximum width of 0.1875 inches. The first slot 54 has a length of 0.375 inches. The second slot 56 has a length of 0.25 inches. The top side 58 of each of the first and second slots 54, 56 is disposed 0.25 inches from the top edge 28. The top side 58 of each of the first and second slots 54, 56 has an inner edge 60. The inner edges 60 are disposed 0.4375 inches apart from each other.

What is claimed is:

1. A power cord male end alignment aid device for accurate alignment and insertion of each of a prong disposed on a male end of a power cord with and into an electrical connector of an electrical energy source, the device comprising:

an irregular octagonal adapter body, the adapter body having a front side, a rear side, and a continuous perimeter therebetween;

wherein the perimeter has a top edge having a pair of opposing first vertices, one of a tapered right upper side edge and a tapered left upper side edge attached to a respective one of the first vertices, an outer side edge conjoined to one of each of the right upper side edge and the left upper side edge in a position perpendicular to the top edge, a tapered lower side edge conjoined to each outer side edge in a position opposite the respective upper side edge, and a bottom edge conjoined to each lower side edge in a position parallel to the top edge and perpendicular to the outer side edges;

a span of the adapter body continuously disposed between the outer side edges, wherein the span is equal to a width of the male end of the power cord;

a round aperture centrally disposed between the lower side edges in a position proximal the bottom edge; and at least a single one of and not more than a pair of an hourglass-shaped slot having a pair of mirror image concave side walls disposed between the outer side edges, the at least single one of and not more than a pair of slots configured to securingly receive the respective prong of the power cord male end therethrough; and wherein concave side walls have a distance between each other, wherein the distance is configured to securingly retain the respective prong between the side walls.

2. The device of claim 1 wherein the pair of the hourglass-shaped slots is vertically disposed on the adapter body in a position parallel to each other and wherein the pair of slots comprises:

a first slot centrally disposed between the top edge and the aperture proximal the left upper side edge;

a second slot disposed between the top edge and the aperture proximal the right upper side edge; and a top side of each of the first and second slots disposed equidistantly from the top edge;

wherein the first slot has a length longer than a length of the second slot;

wherein the electrical connector is a three-hole wall outlet;

wherein the top edge is configured to align with an upper edge of the wall outlet;

wherein the aperture is configured to align with a ground prong receptacle of the three-hole wall outlet; and wherein each of the tapered right and left upper side edges are configured to substantially diagonally align with a respective one of an upper corner of the male end of the power cord and each lower side edge is configured to diagonally align with a respective one of a lower corner of the male end of the power cord.

3. The device of claim 1 wherein the electrical connector is a charging port of a portable electronic device;

wherein the single one of slots is horizontally disposed in a central position proximal the top edge;

wherein the aperture is configured to align with a center of the charging port in a position adjoining a bottom side of a plate surrounding the charging port.

4. The device of claim 2 wherein the adapter body is phosphorescent.

5. The device of claim 2 wherein each of the front side, the rear side, and the perimeter of the adapter body is smooth; and wherein each of the front side, the rear side, the top edge the right upper side edge, the left upper side edge, the outer side edges, the lower side edges, and the bottom edge is flat.

6. The device of claim 3 wherein the adapter body is phosphorescent.

7. The device of claim 3 wherein each of the front side, the rear side, and the perimeter of the adapter body is smooth; and wherein each of the front side, the rear side, the top edge the right upper side edge, the left upper side edge, the outer side edges, the lower side edges, and the bottom edge is flat.

8. The device of claim 4 wherein each of the front side, the rear side, and the perimeter of the adapter body is smooth; and wherein each of the front side, the rear side, the top edge the right upper side edge, the left upper side edge, the outer side edges, the lower side edges, and the bottom edge is flat.

9. The device of claim 6 wherein each of the front side, the rear side, and the perimeter of the adapter body is smooth; and wherein each of the front side, the rear side, the top edge the right upper side edge, the left upper side edge, the outer side edges, the lower side edges, and the bottom edge is flat.

10. A power cord male end alignment aid device for accurate alignment and insertion of each of a prong disposed on a male end of a power cord with and into an electrical connector of an electrical energy source, the device comprising:

an irregular octagonal adapter body, the adapter body having a front side, a rear side, and a continuous perimeter therebetween;

wherein the perimeter has a top edge having a pair of opposing first vertices, one of a tapered right upper side edge and a tapered left upper side edge attached to a respective one of the first vertices, an outer side edge conjoined to one of each of the right upper side edge and the left upper side edge in a position perpendicular to the top edge, a tapered lower side edge conjoined to each outer side edge in a position opposite the respective upper side edge, and a bottom edge conjoined to each lower side edge in a position parallel to the top edge and perpendicular to the outer side edges;

a span of the adapter body continuously disposed between the outer side edges, wherein the span is equal to the male end of the power cord;

a round aperture centrally disposed between the lower side edges in a position proximal the bottom edge; and at least a single one of and not more than a pair of an hourglass-shaped slot having a pair of mirror image concave side walls disposed between the outer side edges, the at least single one of and not more than a pair of slots configured to securingly receive the respective prong of the power cord male end therethrough;

wherein the top edge is configured to align with an upper edge of the wall outlet;

wherein concave side walls have a distance between each other, wherein the distance is configured to securingly retain the respective prong between the side walls;

wherein each of the front side, the rear side, and the perimeter of the adapter body is smooth;

wherein each of the front side, the rear side, the top edge the right upper side edge, the left upper side edge, the outer side edges, the lower side edge, s and the bottom edge is flat; and wherein the adapter body has one of a color selected from the visible spectrum of light, wherein the color is one of a coloration of the plate, a bright, highly visible coloration relative to the plate, and a coloration corresponding to a work-related use of the adapter body.

11. The device of claim 10 wherein the pair of the hourglass-shaped slots is vertically disposed on the adapter body in a position parallel to each other and wherein the pair of slots comprises:

a first slot centrally disposed between the top edge and the aperture proximal the left upper side edge;

a second slot disposed between the top edge and the aperture proximal the right upper side edge; and a top side of each of the first and second slots disposed equidistantly from the top edge;

wherein the first slot has a length longer than a length of the second slot;

wherein the electrical connector is a three-hole wall outlet;

wherein the aperture is configured to align with a ground prong receptacle of the three-hole wall outlet; and wherein each of the tapered right and left upper side edges is configured to substantially diagonally align with a respective one of an upper corner of the male end of the power cord and each lower side edge is configured to diagonally align with a respective one of a lower corner of the male end of the power cord.

12. The device of claim 10 wherein the electrical connector is a charging port of a portable electronic device;

wherein the single one of slots is horizontally disposed in a central position proximal the top edge; and wherein the aperture is configured to align with a center of the charging port and in a position adjoining a bottom side of the plate.

13. The device of claim 10 wherein the adapter body is phosphorescent.

14. The device of claim 11 wherein the adapter body is phosphorescent.

15. The device of claim 11 wherein the adapter body has a maximum length of 1.125 inches, a maximum width of 1.0 inch, and a depth of 0.03125 inches;

wherein the aperture has a diameter of 0.25 inches;

wherein a center of the aperture is disposed 0.875 inches from the top edge;

wherein the top edge has a width of 0.50 inches;

wherein the bottom edge has a width of 0.25 inches;

wherein each outer side edge has a length of 0.50 inches;

wherein each of the right upper side edge and the left upper side edge has a length of 0.25 inches;

wherein each of the lower side edges has a length of 0.50 inches;

wherein each of the first and second slots has a maximum width of 0.375 inches;

wherein the first slot has a length of 0.375 inches; and wherein the second slot has a length of 0.25 inches.

16. The device of claim 12 wherein the adapter body has a maximum length of 0.625 inches, a maximum width of 0.50 inches, and a depth of 0.03125 inches;

wherein the aperture has a diameter of 0.0625 inches;

wherein the top edge has a width of 0.3125 inches;

wherein the bottom edge has a width of 0.1875 inches;

wherein each outer side edge has a length of 0.25 inches;

wherein each of the right upper side edge and the left upper side edge has a length of 0.1875 inches;

wherein each of the lower side edges has a length of 0.25 inches; and wherein the single slot has a maximum width of 0.0625 inches and a length of 0.25 inches.

17. The device of claim 12 wherein the adapter body has a maximum length of 1.125 inches, a maximum width of 1.0 inches, and a depth of 0.03125 inches;

wherein the aperture has a diameter of 0.25 inches;

wherein the top edge has a width of 0.50 inches;

wherein the bottom edge has a width of 0.25 inches;

wherein each outer side edge has a length of 0.25 inches;

wherein each of the right upper side edge and the left upper side edge has a length of 0.1875 inches;

wherein each of the lower side edges has a length of 0.25 inches;

wherein each of the first and second slots has a maximum width of 0.1875 inches;

wherein the first slot has a length of 0.375 inches;

wherein the second slot has a length of 0.25 inches;

wherein the top side of each of the first and second slots is disposed 0.25 inches from the top edge;

wherein the top side of each of the first and second slots has an inner edge;

wherein the inner edges are disposed 0.4375 inches apart from each other.

18. The device of claim 12 wherein the adapter body is phosphorescent.

* * * * *